US005101169A

United States Patent [19]

Gomei

[11] Patent Number: 5,101,169

[45] Date of Patent: Mar. 31, 1992

[54] SYNCHROTRON RADIATION APPARATUS

[75] Inventor: Yoshio Gomei, Yokohama, Japan

[73] Assignee: Kabushiki Kaisha Toshiba, Kawasaki, Japan

[21] Appl. No.: 588,814

[22] Filed: Sep. 27, 1990

[30] Foreign Application Priority Data

Sep. 29, 1989 [JP] Japan ..... 1-254919
Jun. 14, 1990 [JP] Japan ..... 2-155778

[51] Int. Cl.[5] ..... H05H 7/08

[52] U.S. Cl. ..... 328/235; 328/233; 328/230

[58] Field of Search ..... 328/230, 233, 235; 335/210, 211

[56] References Cited

U.S. PATENT DOCUMENTS 4,988,950 1/1991 Nakayama et al. ..... 328/235

FOREIGN PATENT DOCUMENTS 0281399 11/1988 Japan ..... 328/235
0039000 2/1989 Japan ..... 328/235

OTHER PUBLICATIONS

IEEE Transactions on Nuclear Science, vol. NS-28, No. 2, Apr. 1981, NBS-SURF II: A Small, Versatile Synchrotron Light Source, G. Rakowsky.

Nuclear Instruments and Methods in Physics Research A262 (03-1987) pp. 534-536; Yoshio Gomei et al.

*Primary Examiner*—Donald J. Yusko
*Assistant Examiner*—N. D. Patel
*Attorney, Agent, or Firm*—Oblon, Spivak, McClelland, Maier & Neustadt

[57] ABSTRACT

A synchrotron radiation apparatus includes a linear accelerator for accelerating an injected electron beam to 20 MeV or less, an energy compaction system for reducing the energy width of an electron beam, an accumulation ring for permitting the high energy electrons output from the energy compaction system to be circulated therein, an injector for injecting high energy electrons into the accumulation ring, a plurality of deflection electromagnets disposed on the respective corner portions of the accumulation ring, for deflecting the high energy electrons from the injector by a preset angle so as to cause the high energy electrons to be circulated in the accumulation ring, and a plurality of beam lines for guiding to a predetermined position, emission light emitted from the accumulation ring when the high energy electrons are circulated in the accumulation ring at a high speed. Each of the deflection electromagnets includes a core having a pair of magnetic poles arranged to face each other in a direction perpendicular to an electron track on which energy electrons are circulated with the electron track disposed therebetween. The deflection electromagnets further include a yoke for integrally coupling the pair of magnetic poles at one-side ends thereof. The core has a "rectangular C"-shaped cross section and integrally formed in a sector shape, and the width of the yoke in a direction perpendicular to the electron track is set larger than the width of the magnetic pole in a direction perpendicular to the electron track.

15 Claims, 7 Drawing Sheets

SYNCHROTRON RADIATION APPARATUS

BACKGROUND OF THE INVENTION

1. Field of the Invention

This invention relates to a synchrotron radiation apparatus capable of extracting electromagnetic waves emitted when high energy electrons are deflected by a magnetic field.

2. Description of the Related Art

As is well known in the art, the integration density of a semiconductor device is largely dependent on the wavelengths used in an exposure light source. At present, ultraviolet rays are used as the exposure light but it has become extremely difficult to further enhance the integration density by use of the above exposure lights.

With the above problems taken into consideration, recently, various studies have been conducted to use electromagnetic waves (specifically, soft X-rays) emitted when high energy electrons are deflected by a magnetic field and having a large directivity as the exposure light. Actually, some proposals relating to a synchrotron radiation apparatus capable of emitting such an exposure light have been made.

In general, the synchrotron radiation apparatus is constructed to inject high energy electrons accelerated by a pre-accelerator into an accumulation ring held in a vacuum condition, deflect and circulate the injected high energy electrons by use of a plurality of deflection electromagnets mounted along the accumulation ring, and derive out soft X-rays emitted when the high energy electrons are deflected.

In order to simplify application of the synchrotron radiation apparatus in the LSI manufacturing field, for example, some improvements must be made. For example, in the conventional synchrotron radiation apparatus, since the lifetime of low energy electrons is considered to be short, the electrons are accelerated to several hundreds MeV or more by means of a pre-accelerator and the high energy electrons are injected into the accumulation ring and gradually accelerated to the rate energy. Alternatively, the electrons are injected into the acceleration ring at 100 MeV or less and then rapidly accelerated to the rate energy in the acceleration ring, and re-injected into another accumulation ring. In the base cases, since the pre-accelerator used is large, the size of the whole synchrotron radiation apparatus becomes large.

Further, in the conventional synchrotron radiation apparatus, a core called a rectangular type is used as the core for the deflection electromagnets. The core may be formed by laminating a large number of thin plates punched in a form corresponding to the cross section of the core or "rectangular C"-shaped form, for example, into a sector configuration along the electron track. Alternatively, a core called a sector type core formed by laminating a large number of thin plates punched in a "rectangular C"-shaped form into a sector configuration outside the defection track with spacers disposed therebetween may be used as the core for the deflection electromagnets.

However, in sector type core, the cross sectional width of each of the magnetic poles on the electron track side and the cross sectional width of the return yoke are made substantially equal to each other, and the area of the magnetic flux path of the return yoke is made small. It, therefore, becomes difficult to raise the magnetic field to 1.5 T which is considered to be the maximum available magnetic field for the core material and reduce the circumferential length of the accumulation ring by intensifying the deflection magnetic field.

As described above, in the conventional synchrotron radiation apparatus, it is difficult to reduce the size of the whole synchrotron radiation apparatus and accumulate electrons of sufficient amount of energy in the accumulation ring.

SUMMARY OF THE INVENTION

An object of this invention is to provide a synchrotron radiation apparatus capable of reducing the size of the pre-accelerator, decreasing the number of deflection electromagnets and shortening the circumferential length of the accumulation ring to reduce the size of the whole synchrotron radiation apparatus and produce an intense synchrotron radiation output.

According to this invention, a synchrotron radiation apparatus is provided in which a linear accelerator for accelerating electrons to less than 20 MeV or a microtron for accelerating electrons to 60 to 140 MeV is used as a pre-accelerator. The synchrotron radiation apparatus according to the invention uses a core for deflection electromagnets formed in a sector configuration as a whole and having a pair of magnetic poles arranged in a direction perpendicular to an electron track to face each other with the electron track disposed therebetween and a yoke for coupling the paired magnetic poles to each other in the surrounding portion of the electron track. The width of the yoke in a direction perpendicular to the electron track is set larger than the width of the magnetic pole in a direction perpendicular to the electron track.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Before explaining the embodiment of this invention, the theoretical basis of this invention is explained.

According to the conventionally accepted theory, the electron lifetime $\tau_T$ is considered to be extremely short in the low energy region. Based on the above theory, the conventional synchrotron radiation apparatus is constructed to use a large pre-accelerator or adopts a method of injecting electrons into the acceleration ring at less than 100 MeV and then rapidly accelerating the electrons in the accumulation ring.

Figure 5:
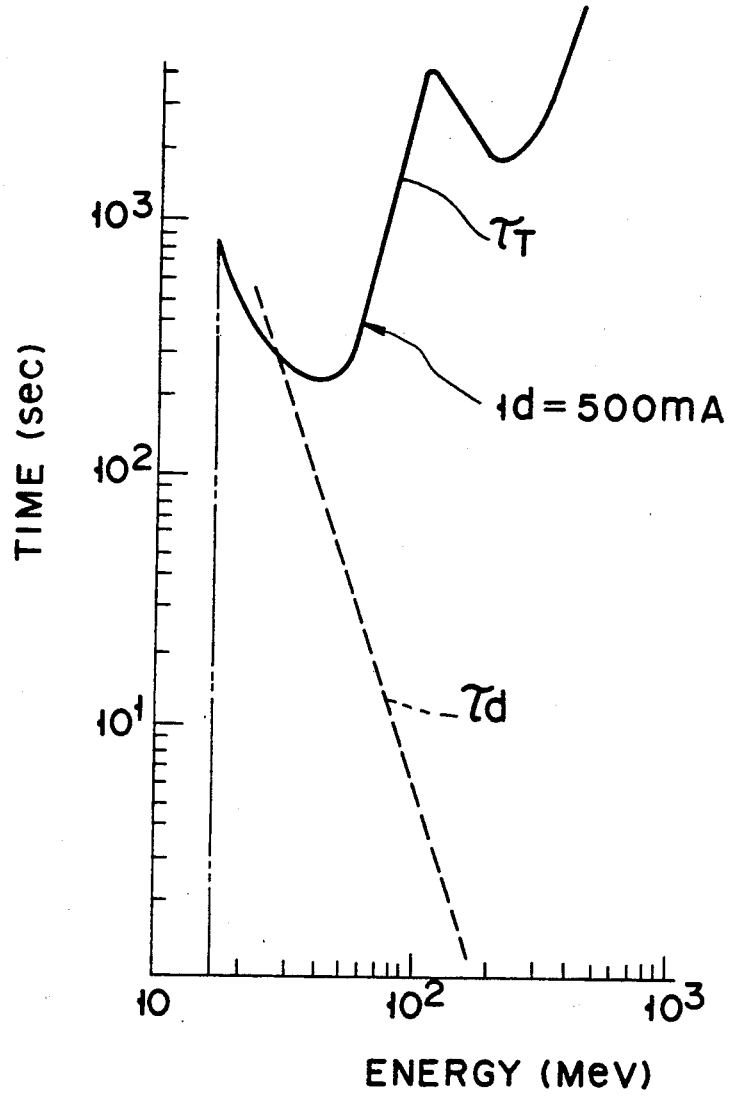
FIG. 5 is a diagram showing the lifetime of electrons derived by calculation which forms the basis of this invention.

However, according to the study by the inventor of this invention, it is proved that the conventional theory is not precisely correct. In FIG. 5, an example of specific calculation made by the inventor is shown. FIG. 5 shows the relation between the electron lifetime $\tau_T$ and radiation damping time $\tau_d$ and the electron energy under a condition that the degree of vacuum in the accumulation ring is $10^{-9}$ Torr and the stored current is 500 mA. It is extremely important to note that bunched electrons are swollen by occurrence of a small amount of coulomb scattering between electrons when the electron lifetime $\tau_T$ is evaluated in a region in which the electron energy is approx. 200 MeV or less. In the example shown in FIG. 5, the swell of the converged electrons is derived by the specific calculation and the electron lifetime $\tau_T$ is determined based on evaluation of the possibility that electrons are scattered at such a large angle as to collide against a wall.

As is clearly seen from FIG. 5, it was found that the lifetime would be as long as 200 seconds even for the electron energy of approx. 50 MeV at which the maximum lifetime $\tau_T$ becomes shortest. This requires the conventionally accepted theory to be corrected. That is, when electrons of 20 MeV or less are injected, the lifetime $\tau_T$ of the injected electrons can be held for several minutes to several tens of minutes. This is disclosed in "Nuclear Instruments and Methods in Physics Research A262 (1987) 534–536 North-Holland Amsterdam" by the inventor of this invention et al.

In the synchrotron radiation apparatus according to this invention, a linear accelerator for accelerating electrons to 20 MeV or less or a microtron for accelerating electrons to 60 to 140 MeV is used as the pre-accelerator.

When electrons of energy of 20 MeV or less are injected into the accumulation ring, time $\tau_d$ in which large oscillation (betatron oscillation) of an electron beam track caused at the electron injection time is attenuated becomes longer than the electron lifetime $\tau_T$. Therefore, in a case where the linear accelerator for accelerating the electrons to 20 MeV or less is used as the pre-accelerator, it becomes impossible to inject electrons by a plurality of times. However, when the linear accelerator is used, it is possible to inject electrons of 500 mA or more at one injection cycle by providing an energy beam converging device in the latter stage. Therefore, an intense synchrotron emission output can be derived by accelerating the electrons to 800 MeV which is a rated value, for example, in a period of relatively long time, for example, one minute which is sufficiently shorter than the lifetime $\tau_T$ after a large current is input and then setting an accumulated state.

On the other hand, when a microtron for accelerating the electrons to 60 to 140 MeV is used as the pre-accelerator, a large current cannot be input at one injection cycle because of its characteristic. However, since the electron lifetime $\tau_T$ is relatively longer than the emission decay time $\tau_d$ as is clearly seen from FIG. 5, it is possible to inject electrons a plurality of times by injecting the electrons each time the betatron oscillation of the incident beam has sufficiently attenuated. Therefore, it is also possible to inject electrons of 500 mA or more. Also, in this case, an intense synchrotron emission output can be derived by accelerating the electrons to 800 MeV which is a rated value, for example, in a period of relatively long time, for example, one minute and then setting an accumulated state.

In this way, a large current electron beam having required energy can be accumulated in the accumulation ring by using the linear accelerator for accelerating electrons to 20 MeV or less or the microtron for accelerating electrons to 60 to 140 MeV without rapidly accelerating the electrons after the electron injecting operation. The linear accelerator or microtron having the above characteristics is generally small and contributes to reduction in size of the whole synchrotron radiation apparatus. Further, since the electrons can be accelerated to a desired energy level without rapidly accelerating the electrons after the electrons are injected into the accumulation ring, a large eddy current will not be induced in the core constituting the deflection electromagnets at the acceleration time, thereby not requiring to make the deflection fields in a laminated structure.

In the synchrotron radiation apparatus according to this invention, since the relation between the widths of the yoke and magnetic poles of the core for each deflection electromagnet is set as described before, the cross sectional area of the magnetic path of the yoke can be set equal to or larger than that of the magnetic pole. Therefore, with the sector type core structure, it becomes possible to supply a magnetic field of approx. 1.5 T which is considered to be the maximum available magnetic field for the normal core material on the electron track. This attains an effect enlarging the deflection angle of a sector type as well as the aforementioned demagnetizing effect electromagnet. As a result, it becomes possible to further reduce the circumferential length of the accumulation ring.

Now, the embodiment is explained with reference to the accompanying drawings.

Figure 1:
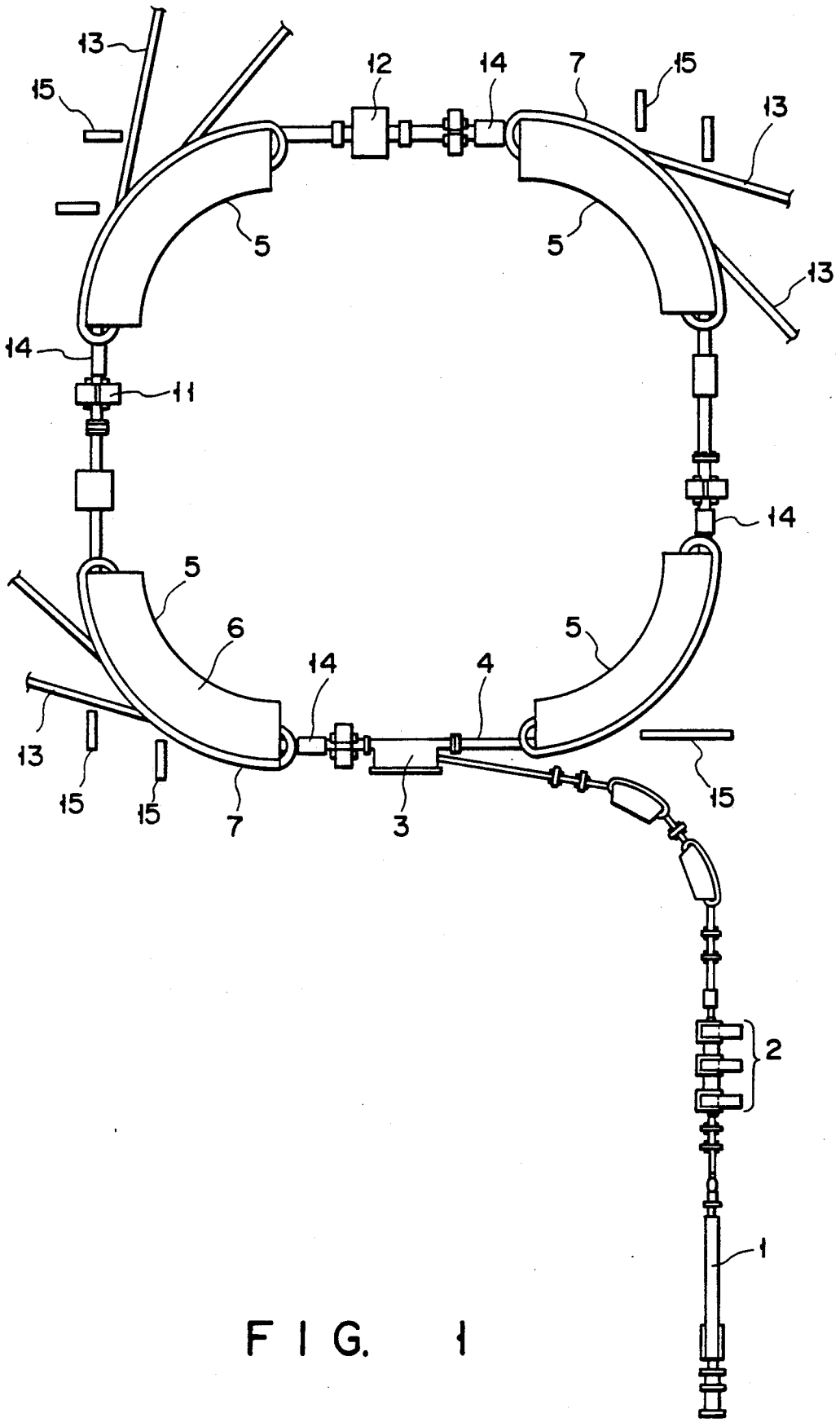
FIG. 1 is a view schematically showing the construction of a synchrotron radiation apparatus according to one embodiment of this invention.

FIG. 1 schematically shows the construction of a synchrotron radiation apparatus according to the embodiment of this invention.

In FIG. 1, a pre-accelerator 1 indicates a linear accelerator and the linear accelerator 1 uses a small-sized linear accelerator for accelerating electrons to 20 MeV or less and 15 MeV in this example.

An electron beam accelerated by the linear accelerator 1 is passed through an energy compaction system 2 using three electron deflecting magnets and an acceleration cavity and then injected into an accumulation ring 4 set in a vacuum condition of approx. $10^{-9}$ Torr via an injection section 3.

The accumulation ring 4 has a beam duct therein. In this example, the accumulation ring 4 is not formed in a complete circular form but in a rectangular frame form. The four corner portions of the accumulation ring 4 are formed of a circular configuration having a length corresponding to one fourth of a circle with a preset radius of curvature. Deflection electromagnets 5 for deflecting electrons traveling in the accumulation ring 4 by a magnetic field 90° are disposed near the respective four circular portions of the accumulation ring 4.

Figure 2:
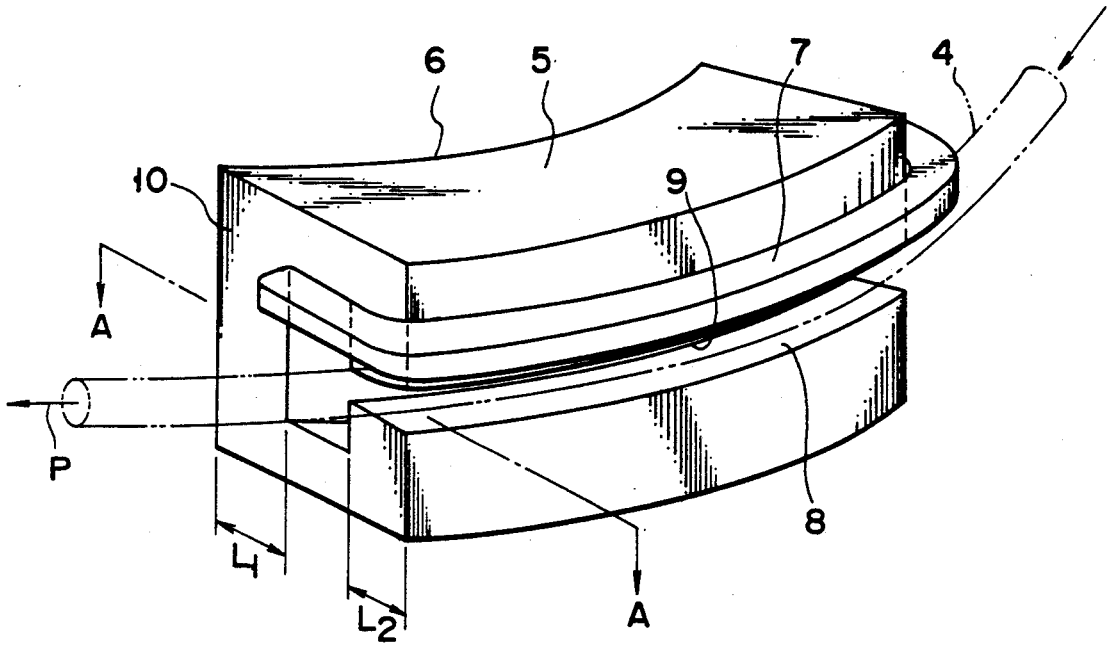
FIG. 2 is a perspective view of one of deflection electromagnets incorporated into the synchrotron radiation apparatus.
Figure 3:
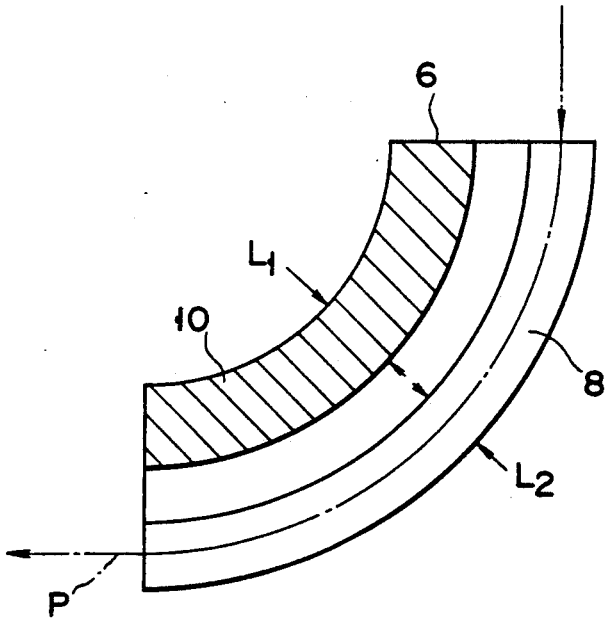
FIG. 3 is a cross sectional view taken along the A—A line of FIG. 2 and viewed in a direction indicated by arrows.

Each of the deflection electromagnets 5 includes a core 6 and a coil 7 formed of a normal conductive coil wound around the core 6. The core 6 is integrally formed in a sector form. That is, as shown in FIG. 2, the core 6 includes a pair of magnetic poles 8 and 9 disposed to face each other in a direction perpendicular to a plane of a electron track P with the electron track P or accumulation ring 4 disposed therebetween and a yoke 10 for coupling the magnetic poles 8 and 9 to each other in the surrounding portion of the central axis of the electron track P. The core 6 is formed to have a "rectangular C"-shaped cross section and is integrally formed in a sector configuration. In this case, as shown in FIG. 3, the width L1 of the yoke 10 in a direction perpendicular to the plane of the electron track P is set larger than the width L2 of the magnetic pole 8 (9) in a direction perpendicular to the plane of the electron track P. That is, the cross sectional area of the magnetic flux path of the yoke 10 is set equal to or larger than that of the magnetic pole 8 or 9 by setting the widths L1 and L2 to have the above relation.

A four-pole magnet 11 is disposed near the straight portion of the accumulation ring 4 and a high frequency acceleration cavity 12 is arranged in one of the straight portions. Beam lines 13 for conducting emission light generated when light energy electrons are bent by the magnetic field are coupled with the inner portion of the accumulation ring 4 in portions located outside the electron track P and on the walls of the circular portions of the accumulation ring 4. Each beam line is coupled to the accumulation ring to extend in the direction of the tangent to the circular portion thereof.

Figure 4:
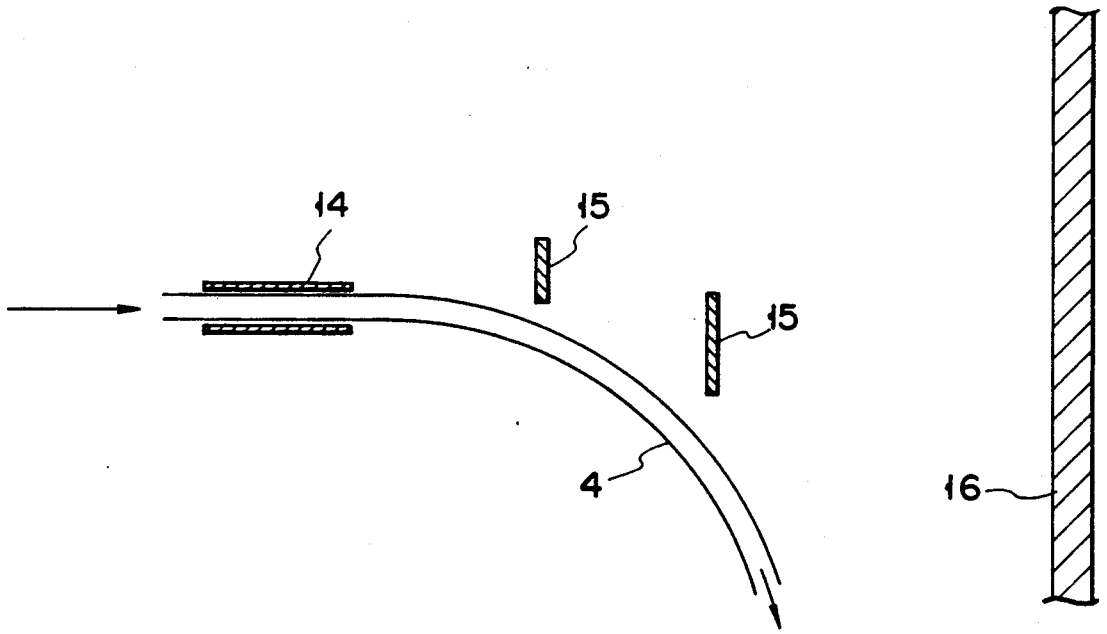
FIG. 4 is a cross sectional view of a curved portion of an accumulation ring incorporated into the synchrotron radiation apparatus.

Further, as shown in FIG. 4, γ-ray shielding members 14 formed of relatively thin lead plates, for example, are mounted on the outer circumference of the accumulation ring 4 in portions ranging from the straight portions to the curved portions of the accumulation ring 4 with respect to the traveling direction of electrons. Further, γ-ray shielding members 15 formed of relatively thin lead plates, for example, are mounted along extension lines of portions ranging from the straight portions to the curved portions of the accumulation ring 4. A member 16 shown in FIG. 4 indicates the wall of a housing.

In the synchrotron radiation apparatus with the above construction, electrons are accelerated to 15 MeV by means of the linear accelerator 1. In general, the energy width of the accelerated electron beam is larger by 1% or more. If the electrons are injected into the accumulation ring 4 as they are, the rate of the electrons which collide against the wall of the accumulation ring 4 becomes larger, making it difficult to produce a large stored current. Therefore, in this embodiment, the electron beam having the large energy width is first supplied to an energy beam converging device 2 so as to have the energy width reduced and is then injected into the accumulation ring 4.

The electron beam injected into the accumulation ring 4 is deflected to travel along the circumferential track in the field set by the deflection magnets 5, accelerated to a higher energy by the high frequency acceleration cavity 12 and circulated. In this case, the field rising speed of the deflection magnet is controlled to accelerate electrons at a relatively small variation rate of approx. 20 MeV/second, for example, by effectively using the fact that the electron lifetime $\tau_T$ is sufficiently long as shown in FIG. 5. An emission light emitted when an electron beam which has been accelerated to a desired energy level in the accumulation ring 4 is deflected by the magnetic field is derived out via the beam lines 13.

When the electron beam is circulated in the accumulation ring 4 as described above, part of the electrons collide against the wall constituting the accumulation ring 4 and at this time γ-rays are generated by the collision. Specific analysis of the phenomenon has proved that it is that wall portion located in the straight portion of the accumulation ring 4 against which electrons are collided with relatively high density and the electrons are collided against the wall portion at an incident angle of approx. 1° or less. In this example, the γ-ray shielding members 14 and 15 are arranged on the outer circumference of the straight portion of the accumulation ring 4 and the extension line of the straight portion based on the result of the above analysis.

Thus, in the above embodiment, the linear accelerator 1 for accelerating electrons to 15 MeV is used as the pre-accelerator. Therefore, the pre-accelerator can be made small and the size of the whole apparatus can be made small. Further, as described above, since even the electron lifetime $\tau_T$ of low energy electrons is sufficiently long, it is not necessary to rapidly accelerate the electrons after they are injected into the accumulation ring 4. Therefore, the generation of the error magnetic field of the deflection electromagnets 5 occurring at the rapid acceleration time can be prevented. Further, since the cross sectional area of the magnetic flux path of the yoke 10 of the core 6 incorporated into the deflection electromagnet 5 is set equal to or larger than that of the magnetic poles 8 and 9, a magnetic field of approx. 1.5 T which is considered to be the maximum available magnetic field of the core material can be supplied on the electron track P of the deflection portion. Therefore, the magnetic field supplied can be raised to substantially an upper limit determined by the core material by using a sector type core which is advantageously used for reducing the size, and as a result, the deflection angle can be made large with the small-sized deflection electromagnet 5 used so that the size of the whole apparatus can be further reduced.

When the γ-ray shielding members 14 and 15 are disposed in the position indicated in the above embodiment, γ-rays can be effectively shielded at portions at which the γ-rays are emitted at relatively high density. Therefore, the shielding function required for the wall 16 of the housing can be significantly alleviated, and as a result, the cost required for the housing and γ-ray shielding can be considerably reduced in total.

Figure 6:
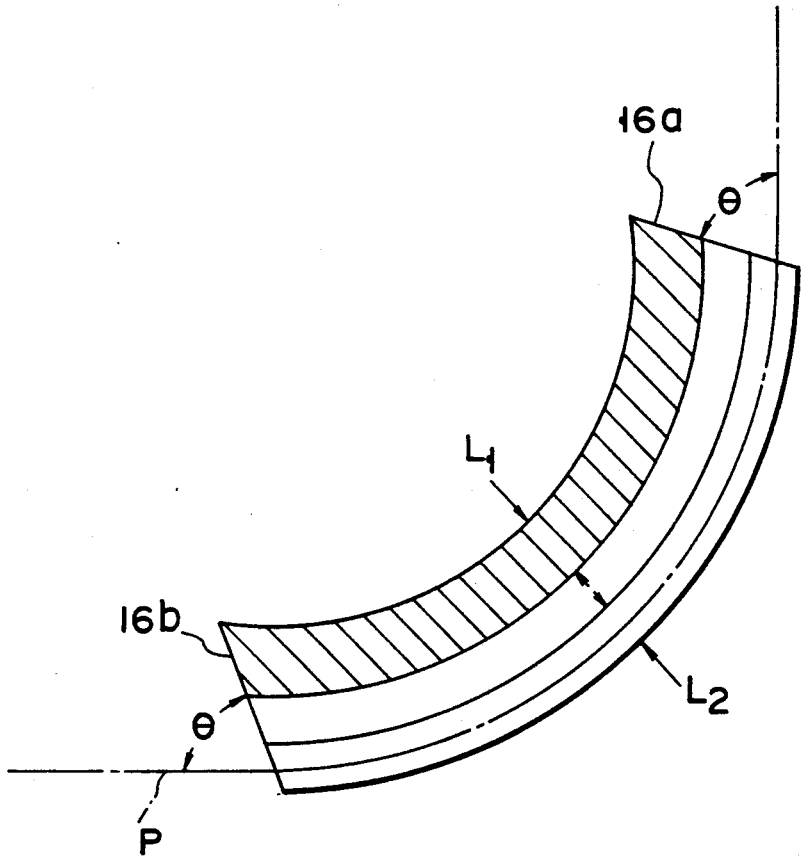
FIG. 6 is a cross sectional view of a modification of the deflection electromagnets.
Figure 7:
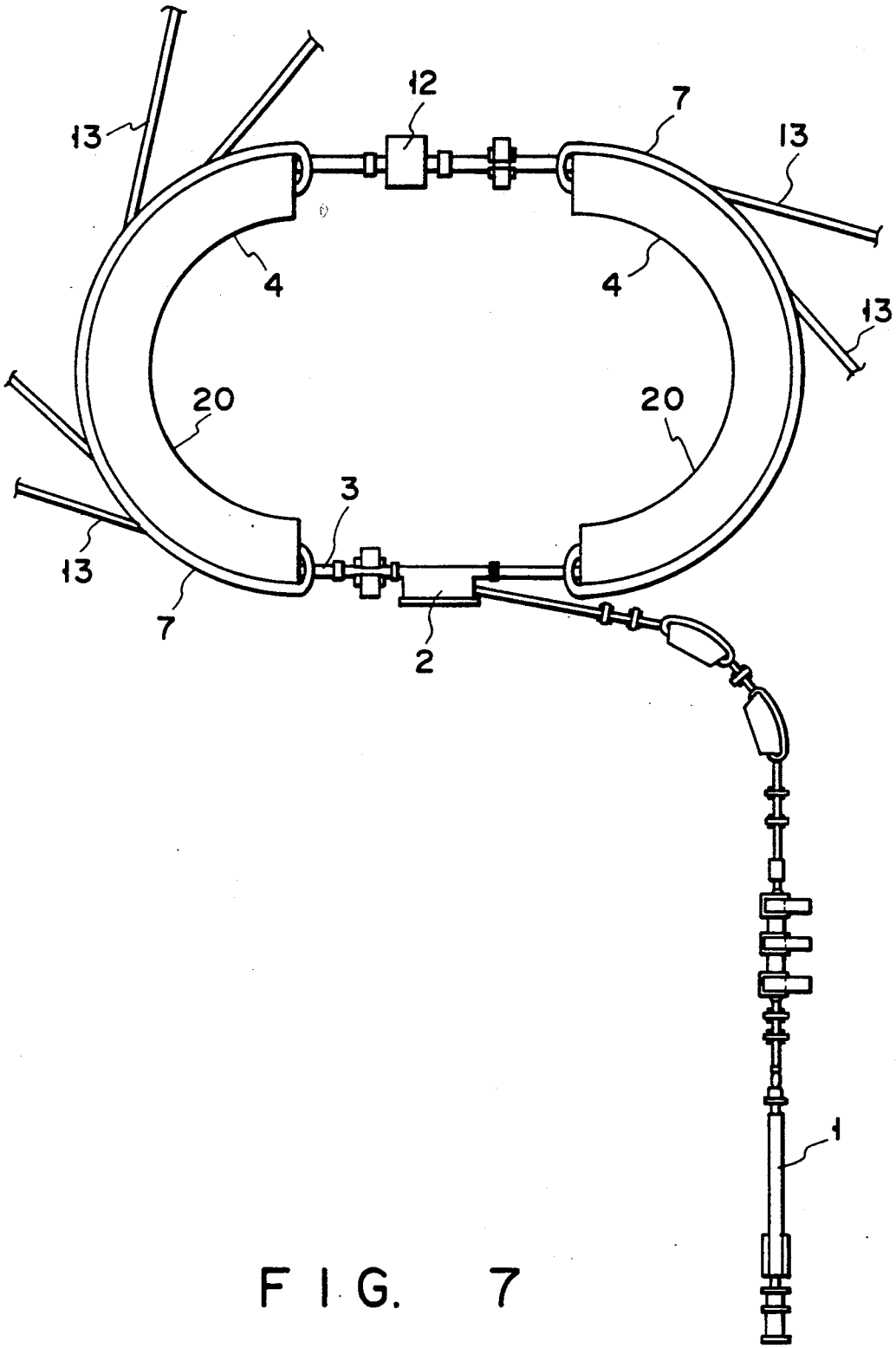
FIG. 7 is a view schematically showing the construction of a synchrotron radiation apparatus using deflection electromagnets having a deflection angle of 180°.

This invention is not limited to the above embodiment. That is, as shown in FIG. 6, the core 6 may be integrally formed to satisfy the condition that L1>L2 and in such a form that the end faces 16*a* and 16*b* of the core 6 in the direction of the electron track P intersect at an angle $\theta$ of 90° or less with respect to the electron track P on the plane of the electron track, thereby further increasing the cross sectional area of the magnetic flux path of the yoke 10. Further, the deflection electromagnet may be formed to deflect an electron beam at a desired deflection angle such as 60° or 180°. For example, when a 180° deflection electromagnet (semi-circular electromagnet) 20 is used, the synchrotron radiation apparatus is constructed as shown in FIG. 7.

Figure 8:
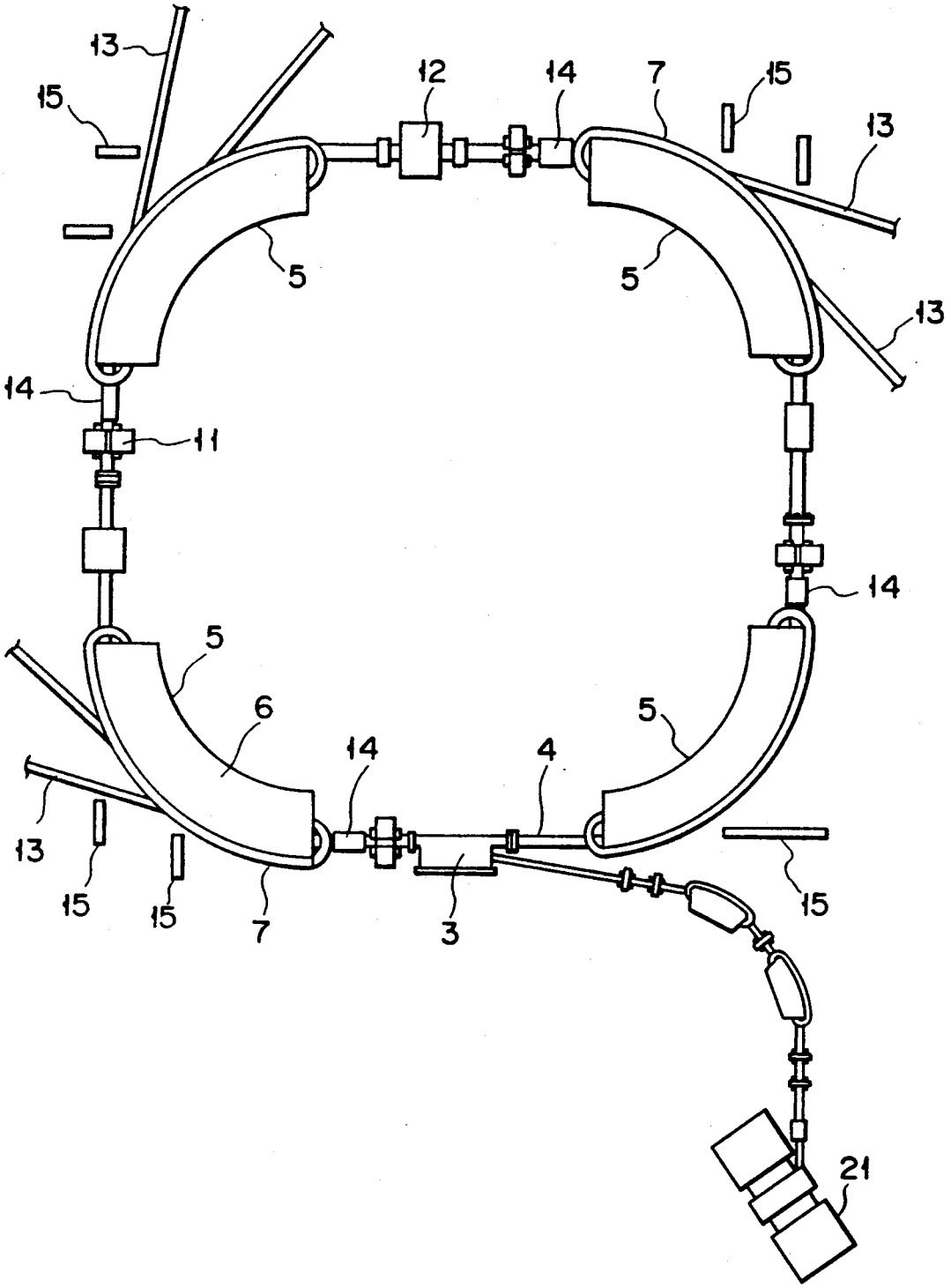
FIG. 8 is a view schematically showing the construction of a synchrotron radiation apparatus using a microtron, according to another embodiment.

Further, in the above embodiment, the small-sized linear accelerator for accelerating electrons to 20 MeV or less is used as the pre-accelerator. However, as shown in FIG. 8, a microtron (21) for accelerating electrons to 60 to 140 MeV can be used as the pre-accelerator. If the microtron is used, the energy beam converging device 2 is omitted.

The microtron having the above function can be made relatively small and will not have any bad influence on compactness of the whole apparatus. In the case of the microtron, an injected current in operation cycle is small for its characteristic, but since the electron lifetime $\tau_T$ is relatively longer than the emission decay time $\tau_d$ in the above energy range, it becomes possible to inject currents by a plurality of times as described before. Therefore, a large current can be stored even when the microtron is used, and the same effect as in the above embodiment can be obtained.

As described above, according to this invention, an intense synchrotron emission output can be obtained while the size of the whole apparatus is made small.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A synchrotron radiation apparatus comprising:

acceleration means for accelerating an injected electron beam;

energy compaction system means for reducing the energy width of the electron beam output from said acceleration means and outputting high energy electrons;

accumulation ring means having a cavity held in a vacuum condition, for permitting the high energy electrons output from said energy compaction system means to be circulated therein;

injecting means for injecting the high energy electrons into said accumulation ring means;

a plurality of deflection electromagnets disposed along said accumulation ring means, for deflecting the injected high energy electrons from said injecting means by a preset angle so as to cause the high energy electrons to be circulated in said accumulation ring means; and beam line means for guiding to a predetermined position, emission light emitted from said accumulation ring means when the high energy electrons are circulated in said accumulation ring means at a high speed;

wherein each of said deflection electromagnets includes a core having a pair of magnetic poles arranged to face each other in a direction perpendicular to an electron track on which energy electrons ar circulated with the electron track disposed therebetween and a yoke for integrally coupling said pair of magnetic poles at one-side ends thereof, said core is formed to have a "rectangular C"-shaped cross section and formed in a shape corresponding to a preset deflection angle, and the width of said yoke in a direction perpendicular to the electron track is set larger than the width of one of said magnetic pole in a direction perpendicular to the electron track.

2. A synchrotron radiation apparatus according to claim 1, wherein said accumulation ring means has a plurality of straight portions and a plurality of circular corner portions and said core of each of said deflection magnets is formed of a core corresponding to the plurality of circular corner portions of said accumulation ring means.

3. A synchrotron radiation apparatus according to claim 2, wherein said core is constituted by a core formed in a sector configuration to deflect said high energy electrons by 90°.

4. A synchrotron radiation apparatus according to claim 2, wherein said core is constituted by a core formed in a semi-circular configuration to deflect said high energy electrons by 180°.

5. A synchrotron radiation apparatus according to claim 1, wherein said acceleration means is constituted by a linear accelerator for accelerating electrons to 20 MeV or less.

6. A synchrotron radiation apparatus according to claim 1, wherein said acceleration means is constituted by a linear accelerator for accelerating electrons to 15 MeV.

7. A synchrotron radiation apparatus according to claim 1, wherein a plurality of $\gamma$-ray shielding members are mounted on at least on of the outer circumference of the straight portions of said accumulation ring means and the extension lines of said straight portions.

8. A synchrotron radiation apparatus comprising:

a microtron for accelerating an injected electron beam and outputting high energy electrons;

an accumulation ring having a cavity held in a vacuum condition and having four corner portions, for permitting the high energy electrons output from said microtron to be circulated therein;

injecting means for injecting the high energy electrons into said accumulation ring;

a plurality of deflection electromagnets disposed on the respective corner portions of said accumulation ring, for deflecting the injected high energy electrons from said injecting means by a preset angle so as to cause the high energy electrons to be circulated in said accumulation ring; and beam line means for guiding to a predetermined position, emission light emitted from said accumulation ring when the high energy electrons are circulated in said accumulation ring at a high speed;

wherein each of said deflection electromagnets includes a core having a pair of magnetic poles arranged to face each other in a direction perpendicular to an electron track on which energy electrons are circulated with the electron track disposed therebetween and a yoke for integrally coupling said pair of magnetic poles at one-side ends thereof, said core is formed to have a "rectangular C"-shaped cross section and integrally formed in a shape corresponding to a predetermined deflection angle, and the width of said yoke in a direction perpendicular to the electron track is set larger than the width of said magnetic pole in a direction perpendicular to the electron track.

9. A synchrotron radiation apparatus according to claim 8, wherein a plurality of $\gamma$-ray shielding members are mounted on at least one of the outer circumference of the straight portions of said accumulation ring and the extension lines of said straight portions.

10. A synchrotron radiation apparatus according to claim 8, wherein said core is constituted by a core formed in a sector configuration to deflect said high energy electrons by 90°.

11. A synchrotron radiation apparatus according to claim 8, wherein said core is constituted by a core formed in a semi-circular configuration to deflect said high energy electrons by 180°.

12. A synchrotron radiation apparatus comprising:

a linear accelerator for accelerating an injected electron beam to 20 MeV or less;

converging means for converging the electron beam output from said linear accelerator and outputting high energy electrons;

an accumulation ring having a cavity held in a vacuum condition and having four corner portions, for permitting the high energy electrons output from said converging means to be circulated therein;

injecting means for injecting the high energy electrons into said accumulation ring;

a plurality of deflection electromagnets disposed on the respective corner portions of said accumulation ring, for deflecting the injected high energy electrons from said injecting means by a preset angle so as to cause the high energy electrons to be circulated in said accumulation ring; and beam line means for guiding to a predetermined position, emission light emitted from said accumulation ring when the high energy electrons ar circulated in said accumulation ring at a high speed;

wherein each of said deflection electromagnets includes a core having a pair of magnetic poles arranged to face each other in a direction perpendicular to a electron track on which energy electrons are circulated with the electron track disposed therebetween and a yoke for integrally coupling said pair of magnetic poles at one-side ends thereof, said core is formed to have a "rectangular C"-shaped cross section and integrally formed in a sector form for 90° deflection, and the width of said yoke in a direction perpendicular to the electron track is set larger than the width of said magnetic pole in a direction perpendicular to the electron track.

13. A synchrotron radiation apparatus according to claim 12, wherein a plurality of γ-ray shielding members are mounted on at least one of the outer circumference of the straight portions of said accumulation ring and the extension lines of said straight portions.

14. A synchrotron radiation apparatus comprising:

a microtron for accelerating an injected electron beam to 60 to 140 MeV and outputting high energy electrons;

an accumulation ring having a cavity held in a vacuum condition and having four corner portions, for permitting the high energy electrons output from said microtron to be circulated therein;

injecting means for injecting the high energy electrons into said accumulation ring;

a plurality of deflection electromagnets disposed on the respective corner portions of said accumulation ring, for deflecting the injected high energy electrons from said injecting means by a preset angle so as to cause the high energy electrons to be circulated in said accumulation ring; and beam line means for guiding emission light emitted from said accumulation ring when the high energy electrons are circulated in said accumulation ring at a high speed to a predetermined position;

wherein each of said deflection electromagnets includes a core having a pair of magnetic poles arranged to face each other in a direction perpendicular to an electron track on which energy electrons are circulated with the electron track disposed therebetween and a yoke for integrally coupling said pair of magnetic poles at one-side ends thereof, said core is formed to have a "rectangular C"-shaped cross section and integrally formed in a sector form for 90° deflection, and the width of said yoke in a direction perpendicular to the electron track is set larger than the width of said magnetic pole in a direction perpendicular to the electron track.

15. A synchrotron radiation apparatus according to claim 10, wherein a plurality of γ-ray shielding members are mounted on at least one of the outer circumference of the straight portions of said accumulation ring and the extension lines of said straight portions.

* * * * *